US005830318A

United States Patent [19]

Snow et al.

[11] Patent Number: 5,830,318

[45] **Date of Patent: *Nov. 3, 1998**

[54] HIGH OPACITY TIPPING PAPER

[75] Inventors: Larry Snow; Kerry Mahone, both of Alpharetta; Italo Baccoli, Marietta, all of Ga.

[73] Assignee: Schweitzer-Mauduit International, Inc., Alpharetta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 738,307

[22] Filed: Oct. 25, 1996

[51] Int. Cl.[6] ..... D21H 15/00

[52] U.S. Cl. ..... 162/139; 131/361; 131/363; 131/365; 162/181.2

[58] Field of Search ..... 162/139, 181.1, 162/181.2; 131/365, 361, 363

[56] References Cited

U.S. PATENT DOCUMENTS

| | | |
|---|---|---|
| 4,411,279 | 10/1983 | Martin et al. . |
| 4,461,311 | 7/1984 | Mathews et al. . |
| 4,480,644 | 11/1984 | Luke . |
| 4,622,983 | 11/1986 | Mathews et al. . |
| 4,725,318 | 2/1988 | Minayoshi et al. . |
| 4,732,748 | 3/1988 | Stewart et al. . |
| 4,805,644 | 2/1989 | Hampl, Jr. et al. . |
| 4,998,543 | 3/1991 | Goodman et al. . |
| 5,060,675 | 10/1991 | Milford et al. . |
| 5,074,321 | 12/1991 | Gentry et al. . |
| 5,103,844 | 4/1992 | Hayden et al. . |
| 5,107,866 | 4/1992 | Aronoff et al. . |
| 5,109,876 | 5/1992 | Hayden et al. . |
| 5,143,098 | 9/1992 | Rogers et al. . |
| 5,156,719 | 10/1992 | Passaretti . |
| 5,161,551 | 11/1992 | Sanders et al. . |
| 5,172,708 | 12/1992 | Drewett et al. . |
| 5,215,734 | 6/1993 | Kunesh et al. . |
| 5,227,025 | 7/1993 | Kunesh et al. . |
| 5,263,500 | 11/1993 | Baldwin et al. . |
| 5,450,863 | 9/1995 | Collins et al. . |

FOREIGN PATENT DOCUMENTS

| | | |
|---|---|---|
| 0447094A1 | 9/1991 | European Pat. Off. . |
| 0513985A1 | 11/1992 | European Pat. Off. . |
| 0791688A1 | 8/1997 | European Pat. Off. . |
| 002056890 | 5/1982 | Japan . |
| 0066599 | 4/1984 | Japan . |
| 1194298 | 8/1985 | Japan . |
| 002056698 | 10/1993 | Japan . |
| 002056889 | 10/1993 | Japan . |
| 405279993 | 10/1993 | Japan . |
| 405279994 | 10/1993 | Japan . |
| 249932 | 8/1969 | U.S.S.R. . |
| 249933 | 8/1969 | U.S.S.R. . |
| 2028832 | 3/1980 | United Kingdom . |

OTHER PUBLICATIONS

European Search Report dated Mar. 4, 1998.
European Search Report dated Mar. 5, 1998.
European Search Report dated Mar. 6, 1998.
Abstract Bulletin of the Institute of Paper Chemistry; No. 6; Dec. 1988; Appleton, Wisconsin.
Specialty Minerals, Inc., 1993, p. 151.0, Albafil ® M Slurry.
Specialty Minerals, Inc., 1993, p. 251.1, Albaglos ® Dry.
Specialty Minerals, Inc., 1994, Ultrapaque ™ Slurry.

*Primary Examiner*—Peter Chin
*Assistant Examiner*—Steven B. Leavitt
*Attorney, Agent, or Firm*—Dority & Manning,P.A.

[57] ABSTRACT

The present invention is directed to a tipping paper adapted for wrapping a filter of a smoking article. The tipping paper contains a pigment made from calcium carbonate particles having a median size of between about 0.1 microns to about 0.5 microns. The calcium carbonate pigment can be used to create a tipping paper having an opacity of up to at least 89%. In comparison to conventional tipping papers, it has been surprisingly discovered that the tipping paper of the present invention reduces knife wear of a cutting instrument used to cut the paper and is less retentive to solvents when the paper is printed with a solvent based ink or covered with a solvent based coating.

24 Claims, No Drawings

HIGH OPACITY TIPPING PAPER

FIELD OF THE INVENTION

The present invention is generally directed to high opacity tipping paper and to a process for making the paper. More particularly, the present invention is directed to using a calcium carbonate filler to produce a high opacity tipping paper that reduces knife wear and has lower solvent retention than prior art constructions.

BACKGROUND OF THE INVENTION

Most cigarettes currently produced include a column of tobacco attached at one end to a filter. The column of tobacco is wrapped in a cigarette wrapping paper and is joined to the filter by a specially made paper called tipping paper. Although there are some exceptions, conventional filters are typically formed from either compressed strips of paper or from cellulose acetate tows. Some filters also include activated carbon.

Filters are attached to the ends of cigarettes in order to filter out particulate matter and other components that may be contained within the cigarette smoke. Filters are also used to blend air with the cigarette smoke when the cigarette is being puffed. The filters are made in a manner that maintains the ratio of air to cigarette smoke within carefully controlled limits so that the cigarette has a constant taste as it is smoked from start to finish. In order to accomplish this goal, the tipping paper surrounding the filter is typically perforated at an end adjacent to the tobacco column.

There are basically two types of cigarette filters: wrapped filters and non-wrapped filters. Wrapped filters are made by wrapping a filter material with a paper known as plug wrap. The plug wrap is machine-rolled with a quantity of heated hot melt adhesive. While the adhesive is still hot, the filter material is anchored to the plug wrap. The plug wrap, which can be machine-perforated or highly porous, must have sufficient stiffness to hold the filter material in a column.

As described above, wrapped and non-wrapped filters are attached to a cigarette rod by the tipping paper. The tipping paper is adhered to both the cigarette paper and the filter by an aqueous adhesive. Different methods of making filters and of attaching the filters to cigarettes are disclosed in U.S. Pat. No. 4,411,279, which is incorporated herein by reference in its entirety.

The tipping paper that is used to connect the filter to the tobacco column is a precisely designed high opacity paper product that must fulfill many requirements and specifications. Tipping paper, for instance, must not discolor when the cigarette is smoked, must not dissolve or degrade when placed in the mouth, must cover discolorations in the filter when the cigarette is smoked, and must hide the union between the tobacco column and the filter. Tipping paper must be capable of being printed upon and should improve the overall appearance of the cigarette.

Of particular concern, tipping paper should also be capable of being coated with an adhesive without losing its aesthetic appearance and without compromising any of the above described characteristics. The tipping paper should be designed so that the adhesive, once coated on the paper, does not bleed through the paper, which can interfere with the ingress of dilution air and can lead to the build up of adhesive material on machine parts contacted during assembly of the cigarette. Further, the tipping paper must be receptive to the adhesive so that the paper will form a sufficient bond to the filter and to the tobacco column.

In general, tipping paper should have an opacity of at least 80% while remaining relatively lightweight. Although it is important that the paper be lightweight, however, the tipping paper must also have enough strength so that the paper does not break as it travels through high speed paper making, printing and cigarette making machines.

Currently, high opacity tipping paper is made almost exclusively using titanium dioxide as a component pigment. The titanium dioxide is typically added to the paper in amounts from about 30 percent to about 50 percent by weight. Adding titanium dioxide to tipping paper has proven to be an effective method for creating papers with high opacities and with a sufficient amount of strength. Tipping paper containing titanium dioxide has also been found to be well suited for use in conjunction with adhesives for bonding the paper to the filter.

Unfortunately, titanium dioxide is a relatively expensive material. Thus, a need exists for a less expensive replacement to titanium dioxide that does not adversely affect the properties of the tipping paper. More particularly, the prior art is deficient in providing a titanium dioxide-free tipping paper that is lightweight, relatively strong, and that meets all of the other above listed requirements of a tipping paper.

SUMMARY OF THE INVENTION

The present invention recognizes and addresses the foregoing disadvantages, and others of prior art constructions and methods.

In general, the present invention is directed to a tipping paper containing a pigment that is primarily made from calcium carbonate. The calcium carbonate contained in the pigment has a particle size and morphology that, when added to tipping paper, results in a lightweight, high strength and high opacity paper.

In the past, calcium carbonate has been used in tipping paper as a pigment. However, calcium carbonates used in the past had a much larger size than the calcium carbonate used in the present invention. Consequently, prior to the present invention, it was not possible to create a high opacity tipping paper using calcium carbonate unless other pigments were added. Further, in the past, in order to approach even midlevel opacities, calcium carbonate had to be added in large amounts which added to the weight of the paper, adversely affected the porosity of the paper, lowered the strength of the paper, and adversely affected the ability of the paper to be run on high speed cigarette making machines. Such disadvantages have been overcome by the present invention.

In one embodiment, the present invention is directed to incorporating into a tipping paper a precipitated calcium carbonate pigment marketed under the name ULTRAPAQUE by Specialty Minerals, Inc. of Adams, Mass. ULTRAPAQUE has been advertised in the past as a replacement to titanium dioxide in some sheeted printed paper products, such as bible paper. Thus far, however, ULTRAPAQUE has not proven to be commercially successful in these applications. Further, ULTRAPAQUE has never been used nor has it ever been suggested to use ULTRAPAQUE as a pigment in tipping paper until the present invention. Once incorporated into tipping paper, the present inventors discovered that ULTRAPAQUE, besides being an effective replacement to titanium dioxide, provides other various unexpected, surprising and unanticipated results not before realized.

Accordingly, it is an object of the present invention to provide an improved tipping paper for use in the construction of smoking articles.

Another object of the present invention is to provide a high opacity tipping paper made using a calcium carbonate pigment.

It is another object of the present invention to provide a tipping paper substantially free of titanium dioxide.

Another object of the present invention is to provide a tipping paper containing calcium carbonate having a particle size between about 0.1 microns to about 0.5 microns.

Still another object of the present invention is to provide a high opacity tipping paper that reduces knife wear of a cutting instrument used to cut the paper in comparison to tipping papers containing titanium.

Another object of the present invention is to provide a tipping paper which, when coated with a solvent based coating or with a solvent based ink, has reduced solvent retention characteristics than prior art papers.

It is another object of the present invention to provide a tipping paper containing a calcium carbonate pigment that has an opacity of greater than 80%.

Still another object of the present invention is to provide a tipping paper that is less expensive to make than conventional tipping papers made with titanium dioxide.

These and other objects of the present invention are achieved by providing a tipping paper adapted for wrapping a filter of a smoking article. The tipping paper includes a paper substrate containing a calcium carbonate pigment. The calcium carbonate has a median particle size of between about 0.1 microns to about 0.5 microns. The calcium carbonate is loaded into the paper substrate in an amount sufficient so that the tipping paper has an opacity of at least 80%.

In one embodiment, the tipping paper has a basis weight of from about 32 gsm to about 42 gsm and more particularly from about 35 gsm to about 38 gsm. The tipping paper can contain only a calcium carbonate pigment and can be substantially free of titanium dioxide.

The calcium carbonate pigment can be added to the paper substrate in an amount from about 20% to about 40% by weight. The tipping paper can have a porosity of up to about 5 Coresta units.

Other objects, features and aspects of the present invention are discussed in greater detail below.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

The present invention is generally directed to a high opacity tipping paper containing a calcium carbonate pigment that is adapted for wrapping a filter of a smoking article. The calcium carbonate pigment can be used alone or in combination with other pigments such as titanium dioxide. In a preferred embodiment, however, the tipping paper is substantially free of titanium dioxide. Although the present invention is generally directed to a white tipping paper, the paper of the present invention can be printed with various designs prior to use, such as a design that gives the paper the appearance of cork.

A tipping paper made according to the present invention is well suited for use in the construction of smoking articles. The tipping paper does not discolor when a cigarette incorporating the paper is smoked, and does not significantly degrade or disintegrate when placed in the mouth. Having high opacities, the tipping paper can cover discolorations in the filter material that may appear during the smoking process and can hide the union or intersection of the filter with the column of tobacco. The paper is lightweight but has sufficient strength to run continuously through high speed paper making, printing and cigarette making machines. The tipping paper of the present invention is also well suited for receiving inks and provides a smooth, printable surface. Overall, cigarettes made using the tipping paper of the present invention have a very aesthetic and pleasing appearance.

Of particular importance, it is believed that the tipping paper of the present invention will meet or exceed any gluing requirements necessary to adhere the paper to a filter. It has been found that the tipping paper can be coated with adhesives without having the adhesives bleed through the paper. Thus far, no noticeable detrimental affects have occurred once the paper has been coated with an adhesive and bonded to a smoking article.

Besides the above advantages of the present invention, it has also been discovered that by incorporating a particular calcium carbonate pigment into a tipping paper, various other unexpected and unanticipated benefits have been obtained.

For instance, it has been discovered that a tipping paper made in accordance with the present invention, as opposed to prior art papers, reduces the knife wear of a cutting instrument used to cut the paper. Prior to going through a cigarette making machine, tipping paper is slit from wide rolls into 2 inch to 4 inch bobbins. Knifewear constitutes a significant portion of down time and efficiency losses during this operation. Further, the machinery that is used to cut the paper is very complicated including not only cutting instruments but also transfer drums with vacuum pickup and release mechanisms. Thus, besides the expense associated with stopping the machinery, it is very expensive to repair or replace the cutting blades contained within the cutting instruments. Consequently, many advantages and benefits are obtained through the use of a tipping paper that reduces knife wear. Although unknown, it is believed that calcium carbonate is less abrasive than titanium dioxide which accounts for the reduction in the wear of the cutting instrument.

Besides reducing knife wear, it has also been unexpectedly discovered that tipping paper containing a calcium carbonate pigment made in accordance with the present invention is better adapted to receive various coatings and inks than convention tipping paper containing titanium dioxide. For instance, tipping paper is typically coated with a solvent-based lip release coating and is often printed with various solvent-based inks. It has been discovered that the tipping paper of the present invention is less solvent retentive than prior art constructions incorporating titanium dioxide.

Since these solvents may affect the taste of the cigarette, the solvents should be evaporated from the tipping paper prior to use. Thus, since conventional tipping paper containing titanium dioxide has a tendency to absorb the solvents, prior art papers have had to be stored for a period of time prior to use where high coating levels, such as cork-on-white designs, are utilized. In comparison, it has been discovered that the tipping paper of the present invention does not similarly retain the solvents contained in coatings and inks and therefore may be used, in most applications, immediately after processing.

Another unexpected advantage realized through use of the tipping paper of the present invention relates to the manner in which the paper is perforated prior to being incorporated into a cigarette. More particularly, in some processes, tipping paper is perforated electrically using an electrode. The paper is perforated in order to allow air to mix with the cigarette smoke during the smoking process. When perforated, conventional tipping paper containing titanium dioxide tends to leave a residue on the electrodes which can interfere with the ability of the electrode to perforate the paper or can cause the electrode to otherwise malfunction. It has been discovered that tipping paper containing calcium carbonate made in accordance with the present invention, on the other hand, does not leave a residue on the electrode when the paper is electrically perforated and does not otherwise interfere with machinery used to perforate the paper.

The construction of the tipping paper of the present invention will now be discussed in greater detail. Generally, the tipping paper of the present invention can be made from cellulosic fibers obtained, for instance, from a blend of softwood fibers and hardwood fibers. For example, in one embodiment the tipping paper can be made from a blend of about 80% softwood fibers by weight combined with about 20% hardwood fibers by weight.

In accordance with the present invention, a calcium carbonate pigment is added to the cellulosic paper. In particular, the median size of the calcium carbonate particles added to the paper should be between about 0.1 microns to about 0.5 microns. In one preferred embodiment, a calcium carbonate pigment marketed under the name ULTRAPAQUE by Specialty Minerals, Inc. of Adams, Mass. is used. ULTRAPAQUE is a precipitated calcium carbonate having a mean particle size of about 0.3 microns. The calcium carbonate particles have a rhombohedral shape/morphology and have a surface area of approximately 7.5 $m^2$/gr. ULTRAPAQUE is commercially available as a slurry containing approximately 40% by weight solids. The slurry can be added directly to the cellulosic fibers during the paper making process.

The calcium carbonate pigment can be added to the tipping paper alone or in combination with other pigments such as titanium dioxide or clay. The calcium carbonate pigment of the present invention can also be added to tipping paper in combination with larger sized and smaller sized calcium carbonate particles. For instance, calcium carbonate particles having a size of from about 0.8 microns to about 1.2 microns and calcium carbonate particles having a size of about 0.07 microns can be added to the tipping paper of the present invention depending upon the desired characteristics. No other pigments, however, are needed in the paper of the present invention in order to achieve any opacity requirements.

The amount of calcium carbonate pigment added to the tipping paper of the present invention will depend primarily on the desired opacity of the paper. Although tipping paper must meet many other specifications and requirements, tipping paper is generally rated based on its opacity. For instance, economy tipping paper should have an opacity of at least 80%, standard grade tipping paper should have an opacity of at least 86%, and premium tipping paper should have an opacity of at least 89%. According to the present invention, it has been found that calcium carbonate particles having a size from about 0.1 microns to about 0.5 microns can be used in tipping paper to produce from economy to premium grades without the need of adding any other pigments, such as titanium dioxide.

In the past, calcium carbonate has been added to tipping paper. Calcium carbonate used in the past, however, had a larger particle size than the calcium carbonate used in the present invention. These larger sized particles were not capable of producing a tipping paper with an opacity of greater than about 80% without having to add exorbitant amounts of pigment to the paper which adversely affected the strength of the paper. It has been found that these drawbacks and deficiencies do not exist when using calcium carbonate pigments having a median particle size of from about 0.1 microns to about 0.5 microns.

In general, the calcium carbonate pigment can be added to the tipping paper of the present invention in an amount from about 20% by weight to about 40% by weight, and more particularly between about 25% by weight to about 35% by weight. In one embodiment, it has been found that adding the calcium carbonate pigment in the amount of about 28% by weight results in a paper having an opacity of about 86%. Increasing the amount of pigment in the paper will increase the opacity.

The basis weight of the tipping paper of the present invention should be between about 32 gsm to about 42 gsm, and more particularly between about 36 gsm to about 38 gsm. As stated above, lower weights and higher opacities are preferred as long as the strength of the paper is not compromised.

The permeability of the tipping paper of the present invention can be up to about 5 Coresta units but is generally not critical.

The present invention may be better understood with reference to the following example.

EXAMPLE

A machine made tipping paper was constructed in accordance with the present invention. The tipping paper contained 28% by weight of ULTRAPAQUE calcium carbonate pigment. The resulting paper had a basis weight of 36 gsm. The tipping paper was measured to have an opacity of 86%. From this Example, it is believed that a premium grade tipping paper containing only the calcium carbonate pigment can also be made having an opacity of at least 89%.

These and other modifications and variations of the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A tipping paper adapted for wrapping a filter of a smoking article comprising:

a paper substrate containing a pigment, said pigment comprising calcium carbonate, said calcium carbonate having a median particle size of between about 0.1 microns to about 0.5 microns, said paper substrate having an opacity of at least 80% wherein said tipping paper has a permeability of less than 5 Coresta Units.

2. A tipping paper as defined in claim 1, wherein said paper has a basis weight of from about 32 gsm to about 42 gsm.

3. A tipping paper as defined in claim 1, wherein said paper has a basis weight of from about 35 gsm to about 38 gsm.

4. A tipping paper as defined in claim 1, wherein said paper substrate has an opacity of at least 86%.

5. A tipping paper as defined in claim 1, wherein said pigment consists essentially of calcium carbonate.

6. A tipping paper as defined in claim 1, wherein said tipping paper is free of titanium dioxide.

7. A tipping paper as defined in claim 1, wherein said pigment is present in said paper substrate in an amount from about 20% to about 40% by weight.

8. A tipping paper as defined in claim 1, wherein said paper is white.

9. A tipping paper as defined in claim 1, wherein said calcium carbonate has a median particle size of about 0.3 microns.

10. A white tipping paper adapted for wrapping a filter of a smoking article comprising:

a titanium dioxide-free paper containing at least one pigment, said at least one pigment consisting essentially of calcium carbonate having a median particle size of between about 0.1 microns to about 0.5 microns, said paper having an opacity of at least 84% and having a basis weight of from about 32 gsm to about 42 gsm and a permeability of less than 5 Coresta Units.

11. A tipping paper as defined in claim 10, wherein said calcium carbonate has a median particle size of about 0.3 microns.

12. A tipping paper as defined in claim 10, wherein said paper has a basis weight of from about 35 gsm to about 38 gsm.

13. A tipping paper as defined in claim 10, wherein said calcium carbonate is present within said paper in an amount from about 20% to about 40% by weight.

14. A tipping paper as defined in claim 10, wherein said paper has an opacity of at least 89%.

15. A smoking article comprising:

a column of a smokable filler;

a filter adjacent to an end of said column of said smokable filler;

a paper wrapper surrounding said column of said smokable filler; and a white tipping paper surrounding said filter, said tipping paper containing a pigment comprising calcium carbonate, said calcium carbonate having a median particle size of between about 0.1 microns to about 0.5 microns and being present in said tipping paper in an amount from about 20% to about 40% by weight, said tipping paper having an opacity of at least 80% and having a basis weight of from about 32 gsm to about 42 gsm and a permeability of less than 5 Coresta Units.

16. A smoking article as defined in claim 15, wherein said calcium carbonate is present within said tipping paper in an amount from about 25% to about 35% by weight.

17. A smoking article as defined in claim 15, wherein said tipping paper has an opacity of at least 86%.

18. A smoking article as defined in claim 15, wherein said tipping paper has an opacity of at least 89%.

19. A smoking article as defined in claim 15, wherein said calcium carbonate contained within said white tipping paper has a median particle size of about 0.3 microns.

20. A method for increasing the opacity of a tipping paper adapted for wrapping a filter of a smoking article, said method comprising the step of:

adding to a paper substrate a pigment comprising calcium carbonate, said calcium carbonate having a median particle size of from about 0.1 microns to about 0.5 microns, said pigment being added to said paper substrate in an amount sufficient for said paper substrate to have an opacity of at least 80%, said paper substrate having a basis weight from about 32 gsm to about 42 gsm and a permeability of less than 5 Coresta Units.

21. A method as defined in claim 20, wherein said paper has an opacity of at least 86%.

22. A method as defined in claim 20, wherein said calcium carbonate is added to said paper substrate in an amount from about 25% to about 35% by weight, said paper substrate having a basis weight of from about 35 gsm to about 38 gsm and said paper substrate being free of titanium dioxide.

23. A method as defined in claim 20, wherein said paper substrate has a porosity of less then 5 Coresta units.

24. A method as defined in claim 20, wherein said calcium carbonate has a median particle size of about 0.3 microns.

* * * * *